US006460307B1

(12) United States Patent
Blain, III

(10) Patent No.: US 6,460,307 B1
(45) Date of Patent: Oct. 8, 2002

(54) BOOM ATTACHMENT FOR A PRIME MOVER

(76) Inventor: Douglas H. Blain, III, 2958 E. T Ave., Kalamazoo, MI (US) 49002

( * ) Notice: Subject to any disclaimer, the term of this patent is extended or adjusted under 35 U.S.C. 154(b) by 8 days.

(21) Appl. No.: 09/718,328

(22) Filed: Nov. 22, 2000

(51) Int. Cl.[7] ..... E04H 12/00

(52) U.S. Cl. ..... 52/633; 52/651.04; 52/651.05; 52/112; 52/690; 52/121; 212/55; 212/59; 212/144

(58) Field of Search ..... 52/651.04, 651.05, 52/561.06, 651.07; 212/55

(56) References Cited

U.S. PATENT DOCUMENTS

| | | | | | |
|---|---|---|---|---|---|
| 2,560,412 | A | * | 7/1951 | Calvert | |
| 2,742,260 | A | * | 4/1956 | Patterson | |
| 3,587,887 | A | | 6/1971 | De Carli | |
| 3,622,013 | A | * | 11/1971 | Swanson | 212/55 |
| 3,658,384 | A | | 4/1972 | Gluszek | |
| 3,812,979 | A | | 5/1974 | Leihgeber | |
| 4,166,542 | A | * | 9/1979 | Bryan, Jr. | 212/55 |
| 4,200,423 | A | | 4/1980 | Sornsin | |
| 4,374,790 | A | * | 2/1983 | McGowan | 264/32 |
| 5,120,186 | A | | 6/1992 | Jorgenson | |
| D402,042 | S | | 12/1998 | Fisher | |
| 5,956,915 | A | * | 9/1999 | Piper et al. | 52/651.05 |

* cited by examiner

*Primary Examiner*—Carl D. Friedman
*Assistant Examiner*—Basil Katcheves

(57) ABSTRACT

A boom attachment for a prime mover for lifting and setting trusses, walls, beams, and related structural components. The boom attachment for a prime mover includes a boom assembly including a prime-mover attachment assembly being adapted to mount to a prime mover, and also including a plurality of elongate support members, and further including transverse and cross members interconnecting the elongate support members; and also includes an extension assembly being movably and adjustably mounted to the boom assembly.

15 Claims, 3 Drawing Sheets

BOOM ATTACHMENT FOR A PRIME MOVER

BACKGROUND OF THE INVENTION

1. Field of the Invention

The present invention relates to a boom attachment and more particularly pertains to a new boom attachment for a prime mover for lifting and setting trusses, walls, beams, and related structural components.

2. Description of the Prior Art

The use of a boom attachment is known in the prior art. More specifically, a boom attachment heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,120,186; 3,812,979; 4,200,423; 3,587,887; 3,658,284; and U.S Pat. No. Des. 402,042.

While these devices fulfill their respective, particular objectives and requirements, the aforementioned patents do not disclose a new boom attachment for a prime mover. The inventive device includes a boom assembly including a prime-mover attachment assembly being adapted to mount to a prime mover, and also including a plurality of elongate support members, and further including transverse and cross members interconnecting the elongate support members; and also includes an extension assembly being movably and adjustably mounted to the boom assembly.

In these respects, the boom attachment for a prime mover according to the present invention substantially departs from the conventional concepts and designs of the prior art, and in so doing provides an apparatus primarily developed for the purpose of lifting and setting trusses, walls, beams, and related structural components.

SUMMARY OF THE INVENTION

In view of the foregoing disadvantages inherent in the known types of boom attachment now present in the prior art, the present invention provides a new boom attachment for a prime mover construction wherein the same can be utilized for lifting and setting trusses, walls, beams, and related structural components.

The general purpose of the present invention, which will be described subsequently in greater detail, is to provide a new boom attachment for a prime mover which has many of the advantages of the boom attachment mentioned heretofore and many novel features that result in a new boom attachment for a prime mover which is not anticipated, rendered obvious, suggested, or even implied by any of the prior art boom attachment, either alone or in any combination thereof.

To attain this, the present invention generally comprises a boom assembly including a prime-mover attachment assembly being adapted to mount to a prime mover, and also including a plurality of elongate support members, and further including transverse and cross members interconnecting the elongate support members; and also includes an extension assembly being movably and adjustably mounted to the boom assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new boom attachment for a prime mover which has many of the advantages of the boom attachment mentioned heretofore and many novel features that result in a new boom attachment for a prime mover which is not anticipated, rendered obvious, suggested, or even implied by any of the prior art boom attachment, either alone or in any combination thereof.

It is another object of the present invention to provide a new boom attachment for a prime mover which may be easily and efficiently manufactured and marketed.

It is a further object of the present invention to provide a new boom attachment for a prime mover which is of a durable and reliable construction.

An even further object of the present invention is to provide a new boom attachment for a prime mover which is susceptible of a low cost of manufacture with regard to both materials and labor, and which accordingly is then susceptible of low prices of sale to the consuming public, thereby making such boom attachment for a prime mover economically available to the buying public.

Still yet another object of the present invention is to provide a new boom attachment for a prime mover which provides in the apparatuses and methods of the prior art some of the advantages thereof, while simultaneously overcoming some of the disadvantages normally associated therewith.

Still another object of the present invention is to provide a new boom attachment for a prime mover for lifting and setting trusses, walls, beams, and related structural components.

Yet another object of the present invention is to provide a new boom attachment for a prime mover which includes a boom assembly including a prime-mover attachment assembly being adapted to mount to a prime mover, and also including a plurality of elongate support members, and further including transverse and cross members interconnecting the elongate support members; and also includes an extension assembly being movably and adjustably mounted to the boom assembly.

Still yet another object of the present invention is to provide a new boom attachment for a prime mover that is easy and convenient to attach to a prime mover such as a skid steer.

Even still another object of the present invention is to provide a new boom attachment for a prime mover that is versatile and strong to withstand a lot of weight being put on the top transverse member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
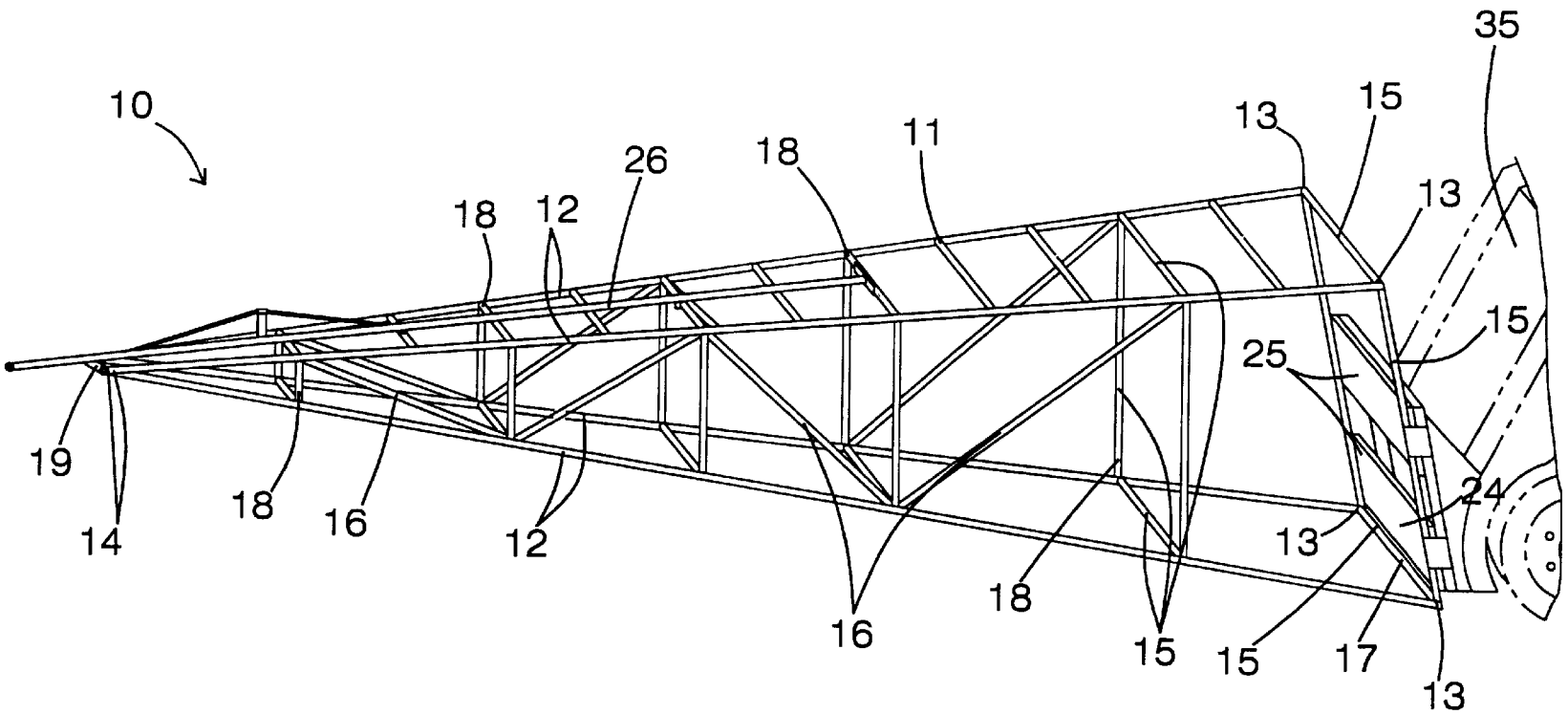
FIG. 1 is a perspective view of a new boom attachment for a prime mover according to the present invention and shown in use.
Figure 2:
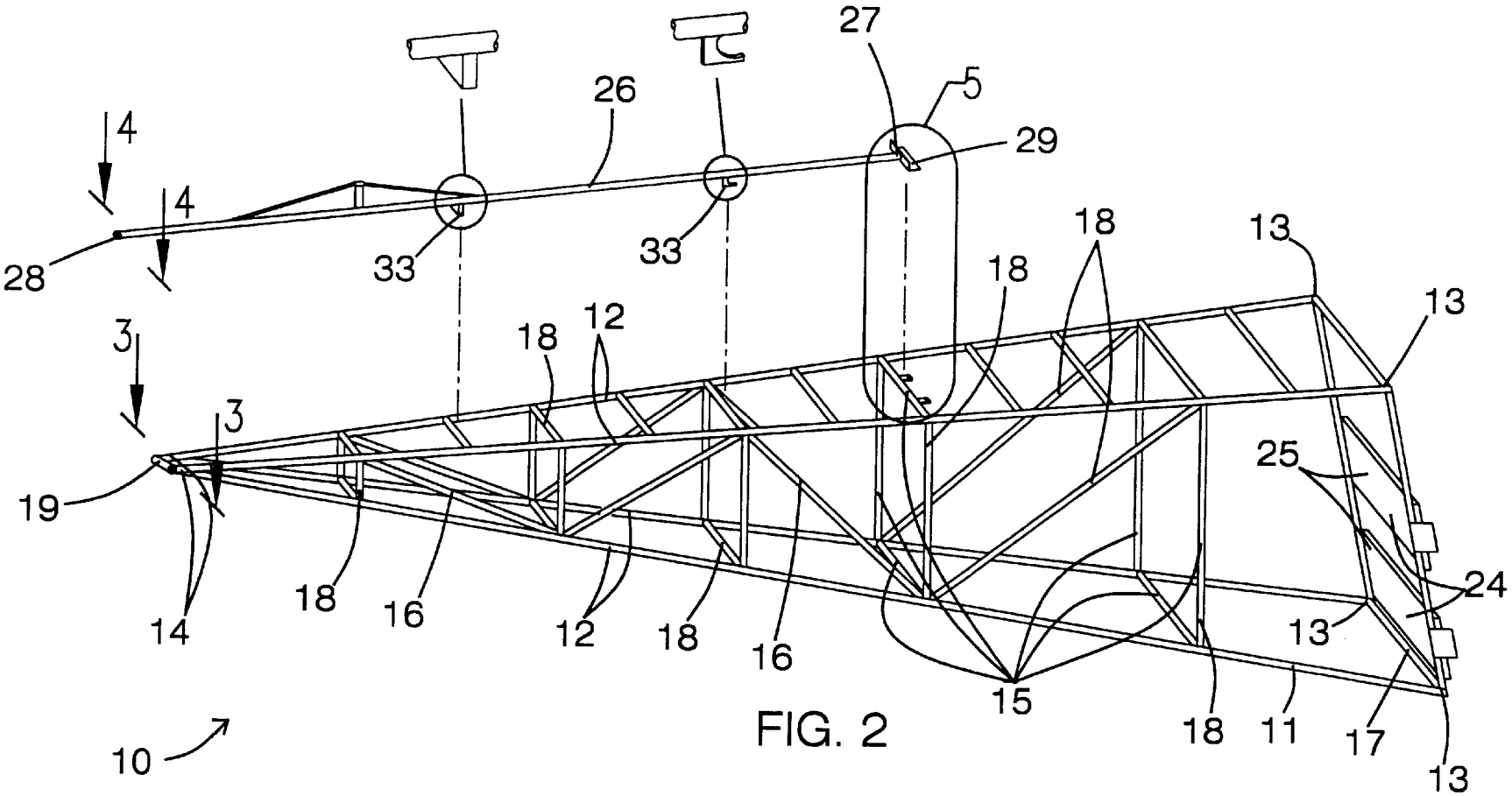
FIG. 2 is an exploded perspective view of the present invention.
Figure 3:
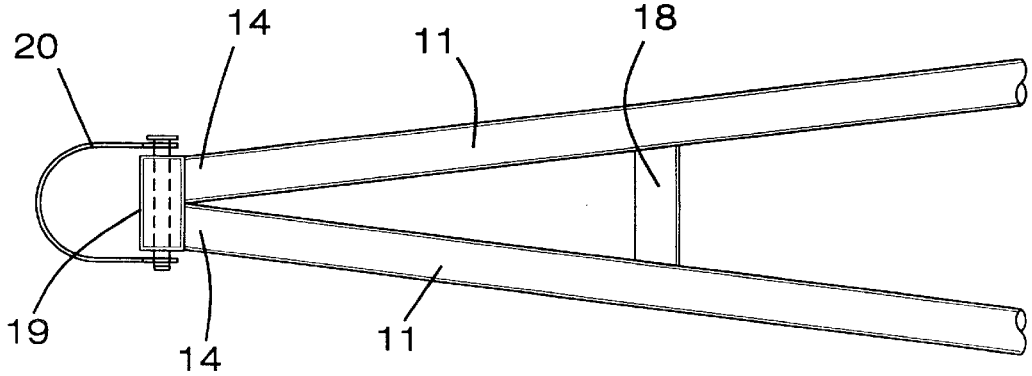
FIG. 3 is a detailed top plan view of the boom assembly of the present invention.
Figure 4:
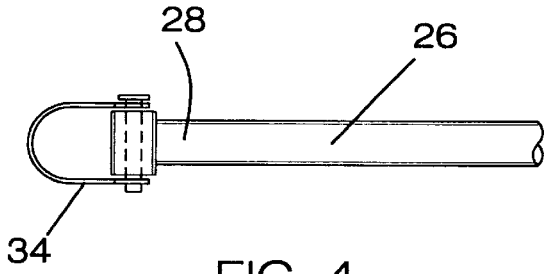
FIG. 4 is a detailed top plan view of the extension member of the present invention.
Figure 5:
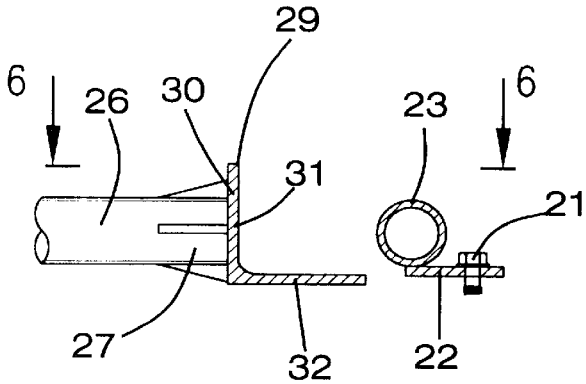
FIG. 5 is a detailed end elevational view of the adjoining portions of the extension member and the boom member of the present invention.
Figure 6:
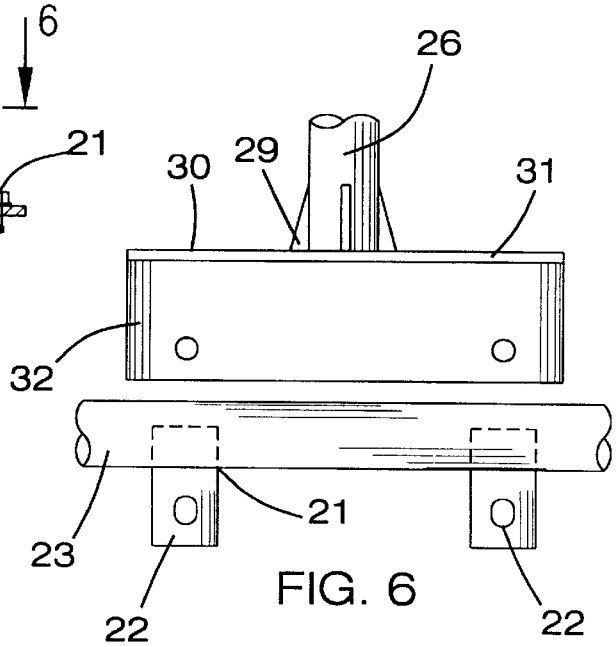
FIG. 6 is a detailed side elevational view of the adjoining portions of the extension member and the boom member of the present invention.

With reference now to the drawings, and in particular to FIGS. 1 through 6 thereof, a new boom attachment for a prime mover embodying the principles and concepts of the present invention and generally designated by the reference numeral 10 will be described.

As best illustrated in FIGS. 1 through 6, the boom attachment for a prime mover 10 generally comprises a boom assembly 11 including a prime-mover attachment assembly 24 being adapted to mount to a prime mover 35, and also including a plurality of elongate support members 12, and further including transverse 15,19 and cross members 16 interconnecting the elongate support members 12. The transverse members 15 include base transverse members which are securely and conventionally attached at first ends 13 of the elongate support members 12. The first ends 13 of the elongate support members 12 are spaced apart. The base transverse members 15 are arranged to form a base rectangular structure 17 with the first ends 13 of the elongate support members 12 being at corners of the base rectangular structure 17. The transverse members 15,19 further includes a plurality of intermediate transverse members being arranged to form a plurality of intermediate rectangular structures 18. The intermediate rectangular structures 18 are spaced apart with the elongate support members 12 being conventionally attached at corners of the intermediate rectangular structures 18. The transverse members 15,19 also include a top transverse member 19 being securely attached to second ends 14 of the elongate support members 12. The boom assembly 11 is tapered from the first ends 13 of the elongate support members 12 to the second ends 14 of the elongate support members 12. Pairs of the elongate support members 12 are conventionally and securely attached to ends of the top transverse member 19. The cross members 16 generally interconnect the intermediate rectangular structures 18 to further strengthen the boom assembly 11. The boom assembly 11 further includes an extension support assembly 21 being securely and conventionally attached to one of the intermediate rectangular structures 18. The extension support assembly 21 includes bracket members 22 which are conventionally attached to the intermediate rectangular structure 18 and also includes a tubular support member 23 being securely and conventionally attached to the bracket members 22. The prime-mover attachment assembly 24 includes plate-like members 25 being securely and conventionally attached to the base rectangular structure 15. The boom assembly 11 further includes a first clevis member 20 being securely and conventionally attached to the top transverse member 19.

An extension assembly is movably and adjustably mounted to the boom assembly 11. The extension assembly includes an elongate tubular member 26 having a first end 27 and a second end 28 and being extendable through the first clevis member 20, and also includes a base support member 29 being securely and conventionally attached to the first end 27 of the elongate tubular member 26 and being supportable upon the tubular support member 23 of the boom assembly 11, and further includes hook-like bracket members 33 being securely and conventionally attached to the elongate tubular member 26 and being adapted to hook upon the intermediate transverse members 15, and also includes a second clevis member 34 which is securely and conventionally attached to the second end 28 of the elongate tubular member 26. The base support member 29 is generally an angled plate-like member 30 having a first portion 31 which is securely and conventionally attached perpendicularly to the first end 27 of the elongate tubular member 26 and also having a second portion 32 which is angled approximately 90 degrees relative to the first portion 31 and which is removably mounted upon the extension support assembly 21 for holding the elongate support member 26 upon the boom assembly In use, the user attaches the prime-mover attachment assembly 24 to the prime mover 35 and moves the boom assembly 11 upwardly to the desired location and uses the second clevis member 34 to hook onto trusses, beams and other structural components and moves such structural components to the desired locations.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A boom attachment for a prime mover comprising:

a boom assembly including a prime-mover attachment assembly being adapted to mount to a prime mover, and also including a plurality of elongate support members, and further including transverse and cross members interconnecting said elongate support members;

an extension assembly being movably and adjustably mounted to said boom assembly;

wherein said transverse members further include a plurality of intermediate transverse members being arranged to form a plurality of intermediate rectangular structures, said intermediate rectangular structures being spaced apart with one each of said elongate support members being attached at a respective corner of each of said intermediate rectangular structures; and wherein said boom assembly further includes an extension support assembly being attached to one of said intermediate rectangular structures, said extension support assembly including bracket members which are attached to said intermediate rectangular structure and also including a tubular support member being attached to said bracket members.

2. A boom attachment for a prime mover as described in claim 1, wherein said transverse members include base transverse members which are attached at first ends of said elongate support members, said first ends of said elongate support members being spaced apart, said base transverse members being arranged to form a base rectangular structure with said first ends of said elongate support members being at corners of said base rectangular structure.

3. A boom attachment for a prime mover as described in claim 1, wherein said transverse members also includes a top transverse member being attached to second ends of said elongate support members.

4. A boom attachment for a prime mover as described in claim 2, wherein said boom assembly is tapered from said first ends of said elongate support members to said second ends of said elongate support members, pairs of said elongate support members being attached to ends of said top transverse member.

5. A boom attachment for a prime mover as described in claim 1, wherein said cross members generally interconnect said intermediate rectangular structures to further strengthen said boom assembly.

6. A boom attachment for a prime mover as described in claim 2, wherein said prime-mover attachment assembly includes plate-like members being attached to said base rectangular structure.

7. A boom attachment for a prime mover as described in claim 4, wherein said boom assembly further includes a first clevis member being attached to said top transverse member.

8. A boom attachment for a prime mover as described in claim 7, wherein said extension assembly includes an elongate tubular member having a first end and a second end and being extendable through said first clevis member, and also includes a base support member being attached to said first end of said elongate tubular member and being supportable upon said tubular support member of said boom assembly, and further includes hook-like bracket members being attached to said elongate tubular member and being adapted to hook upon said intermediate transverse members, and also includes a second clevis member which is attached to said second end of said elongate tubular member.

9. A boom attachment for a prime mover as described in claim 8, wherein said base support member is generally an angled plate-like member having a first portion which is attached perpendicularly to said first end of said elongate tubular member and also having a second portion which is angled approximately 90 degrees relative to said first portion and which is removably mounted upon said extension support assembly for holding said elongate support member upon said boom assembly.

10. A boom attachment for a prime mover comprising:

a boom assembly including a prime-mover attachment assembly being adapted to mount to a prime mover, and also including a plurality of elongate support members, and further including transverse and cross members interconnecting said elongate support members;

an extension assembly being movably and adjustably mounted to said boom assembly;

wherein said transverse members include base transverse members which are attached at first ends of said elongate support members, said first ends of said elongate support members being spaced apart, said base transverse members being arranged to form a base rectangular structure with said first ends of said elongate support members being at corners of said base rectangular structure;

wherein said transverse members further include a plurality of intermediate transverse members being arranged to form a plurality of intermediate rectangular structures, said intermediate rectangular structures being spaced apart with said elongate support members being attached at corners of said intermediate rectangular structures;

wherein said transverse members also includes a top transverse member being attached to second ends of said elongate support members;

wherein said boom assembly is tapered from said first ends of said elongate support members to said second ends of said elongate support members, pairs of said elongate support members being attached to ends of said top transverse member;

wherein said cross members generally interconnect said intermediate rectangular structures to further strengthen said boom assembly; and wherein said boom assembly further includes an extension support assembly being attached to one of said intermediate rectangular structures, said extension support assembly including bracket members which are attached to said intermediate rectangular structure and also including a tubular support member being attached to said bracket members.

11. A boom attachment for a prime mover as described in claim 10, wherein said prime-mover attachment assembly includes plate-like members being securely attached to said base rectangular structure.

12. A boom attachment for a prime mover as described in claim 10, wherein said boom assembly further includes a first clevis member being attached to said top transverse member.

13. A boom attachment for a prime mover as described in claim 12, wherein said extension assembly includes an elongate tubular member having a first end and a second end and being extendable through said first clevis member, and also includes a base support member being attached to said first end of said elongate tubular member and being supportable upon said tubular support member of said boom assembly, and further includes hook-like bracket members being attached to said elongate tubular member and being adapted to hook upon said intermediate transverse members, and also includes a second clevis member which is attached to said second end of said elongate tubular member.

14. A boom attachment for a prime mover as described in claim 13, wherein said base support member is generally an angled plate-like member having a first portion which is attached perpendicularly to said first end of said elongate tubular member and also having a second portion which is angled approximately 90 degrees relative to said first portion and which is removably mounted upon said extension support assembly for holding said elongate support member upon said boom assembly.

15. A boom attachment for a prime mover comprising:

a boom assembly including a prime-mover attachment assembly being adapted to mount to a prime mover, and also including a plurality of elongate support members, and further including transverse and cross members interconnecting said elongate support members, said transverse members including base transverse members which are attached at first ends of said elongate support members, said first ends of said elongate support members being spaced apart, said base transverse members being arranged to form a base rectangular structure with said first ends of said elongate support members being at corners of said base rectangular structure, said transverse members further including a plurality of intermediate transverse members being arranged to form a plurality of intermediate rectangular structures, said intermediate rectangular structures being spaced apart with one each of said elongate support members being attached at a respective corner of each of said intermediate rectangular structures, said transverse members also including a top transverse member being attached to second ends of said elongate support members, said boom assembly being tapered from said first ends of said elongate support members to said second ends of said elongate support members, pairs of said elongate support members being attached to ends of said top transverse member, said cross members generally interconnecting said intermediate rectangular structures to further strengthen said boom assembly, said boom assembly further including an extension support assembly being attached to one of said intermediate rectangular structures, said extension support assembly including bracket members which are attached to said intermediate rectangular structure and also including a tubular support member being attached to said bracket members, said prime-mover attachment assembly including plate-like members being attached to said base rectangular structure, said boom assembly further including a first clevis member being attached to said top transverse member; and an extension assembly being movably and adjustably mounted to said boom assembly, said extension assembly including an elongate tubular member having a first end and a second end and being extendable through said first clevis member, and also including a base support member being attached to said first end of said elongate tubular member and being supportable upon said tubular support member of said boom assembly, and further including hook-like bracket members being attached to said elongate tubular member and being adapted to hook upon said intermediate transverse members, and also including a second clevis member which is attached to said second end of said elongate tubular member, said base support member being generally an angled plate-like member having a first portion which is attached perpendicularly to said first end of said elongate tubular member and also having a second portion which is angled approximately 90 degrees relative to said first portion and which is removably mounted upon said extension support assembly for holding said elongate support member upon said boom assembly.

* * * * *